US005082748A

United States Patent [19]

Ahn et al.

[11] Patent Number: 5,082,748

[45] Date of Patent: Jan. 21, 1992

[54] FE-MN ALLOY PLATED STEEL SHEET AND MANUFACTURING METHOD THEREOF

[75] Inventors: Duk S. Ahn; Jae R. Lee; Chan S. Park, all of Pohong, Rep. of Korea

[73] Assignees: Pohang Iron & Steel Co., Ltd.; Research Institute of Industrial Science & Technology, both of Pohong, Rep. of Korea

[21] Appl. No.: 459,152

[22] Filed: Dec. 29, 1989

[30] Foreign Application Priority Data

Dec. 30, 1988 [KR] Rep. of Korea ..... 88-17930

[51] Int. Cl.[5] ..... B32B 15/00

[52] U.S. Cl. ..... 428/656; 420/72; 428/658; 428/659

[58] Field of Search ..... 428/655, 656, 658, 659; 148/254, 255, 329; 420/72

[56] References Cited

U.S. PATENT DOCUMENTS 2,133,291 10/1938 Gordon ..... 420/72

FOREIGN PATENT DOCUMENTS 2161499A 1/1986 United Kingdom ..... 428/659

*Primary Examiner*—R. Dean
*Assistant Examiner*—Robert R. Koehler
*Attorney, Agent, or Firm*—Millen, White & Zelano

[57] ABSTRACT

An Fe-Mn steel sheet plated with an electrodeposited lower layer of Zn or a Zn alloy and as an upper layer at least 0.5 g/mn$^2$ of an Fe-Mn alloy with a manganese content of no more than 60% by weight, electrodeposited on the lower layer, has improved corrosion resistance.

6 Claims, 4 Drawing Sheets

FE-MN ALLOY PLATED STEEL SHEET AND MANUFACTURING METHOD THEREOF

BACKGROUND OF THE INVENTION

This invention relates to a highly corrosion resistant plated steel strip or sheet and manufacturing method thereof and, more particularly to a Fe-Mn plated steel strip intended for use in automobiles with its excellent phosphate treatability, adhesion and corrosion resistance after painting, and manufacturing method thereof.

For steel strips intended for use in automobiles, the plating layer showing excellent phosphate treatability, adhesion and corrosion resistance after painting is typically required.

The process for making a corrosion resistant plated steel sheet are disclosed by GB 2140035A and EP 0125658. GB 2140035A discloses an iron-zinc alloy electro-galvanized steel sheet having a plurality of iron-zinc alloy coatings comprising; a lower layer formed on the surface of a steel sheet; and an upper layer comprising at least two iron-zinc alloy coatings formed on the lower layer. The iron content of each coating in the lower layer is from 1–15 wt % and the total coating weight of the lower layer is from 1 to 50 g/m$^2$. And the iron content of each of the coatings in the upper layer is over 15 wt % and the total coating weight of the upper layer is from 1–40 g/m$^2$.

EP 0125658 discloses a steel strip having a layer of Fe-P alloy with a phosphorus content of from 0.0003 to 15% by weight electrodeposited on at least one surface of the steel strip to build-up of at least 0.01 g/m$^2$ of Fe-P alloy on the underlying layer of zinc or zinc alloy.

The above-mentioned prior arts involves the following problems;

The iron-zinc alloy electro-galvanized steel sheet disclosed in GB 2140035A exhibit inferior corrosion resistance, because moisture penetrated throught cutting or scratch reacts with zinc to form powder-type corrosion product of zinc hydroxide that further allows water to penetrate.

And the Fe-P plated steel strip disclosed in EP 0125658 is revealed to have the peeling off problem in the upper plated layer, that is caused by increase of brittleness due to phosphorus and also by poor adhesion due to small amount of Fe or P segregated during early period of plating process forming the upper layer via unnecessary non-electrolytic reaction between zinc ions contained in the lower plated layer and Fe or P ions in plating bath.

SUMMARY OF THE INVENTION

It is, therefore, an object of the present invention to provide a plated steel strip having excellent phosphate treatability, adhesion and corrosion resistance after painting, and manufacturing method thereof.

According to an aspect of the present invention, there is provided a corrosion resistant Fe-Mn plated steel strip comprising a steel strip; a lower layer of Zn or Zn alloy electrodeposited on the surface of the steel strip; and an upper layer of Fe-Mn alloy electrodeposited on said layer.

According to another aspect of the present invention, there is provided a method for making an Fe-Mn alloy plated steel strip comprising, forming a lower plating layer of Zn or Zn alloy on the surface of a steel sheet; and forming an upper plating layer of Fe-Mn alloy on the surface of said lower plating layer.

BRIEF DESCRIPTION OF THE DRAWINGS

This invention will be more fully understood and further advantages will be come apparent when reference is made to the following detailed description and the accompanying drawings in which.

DETAILED DESCRIPTION OF THE INVENTION

Figure 1:
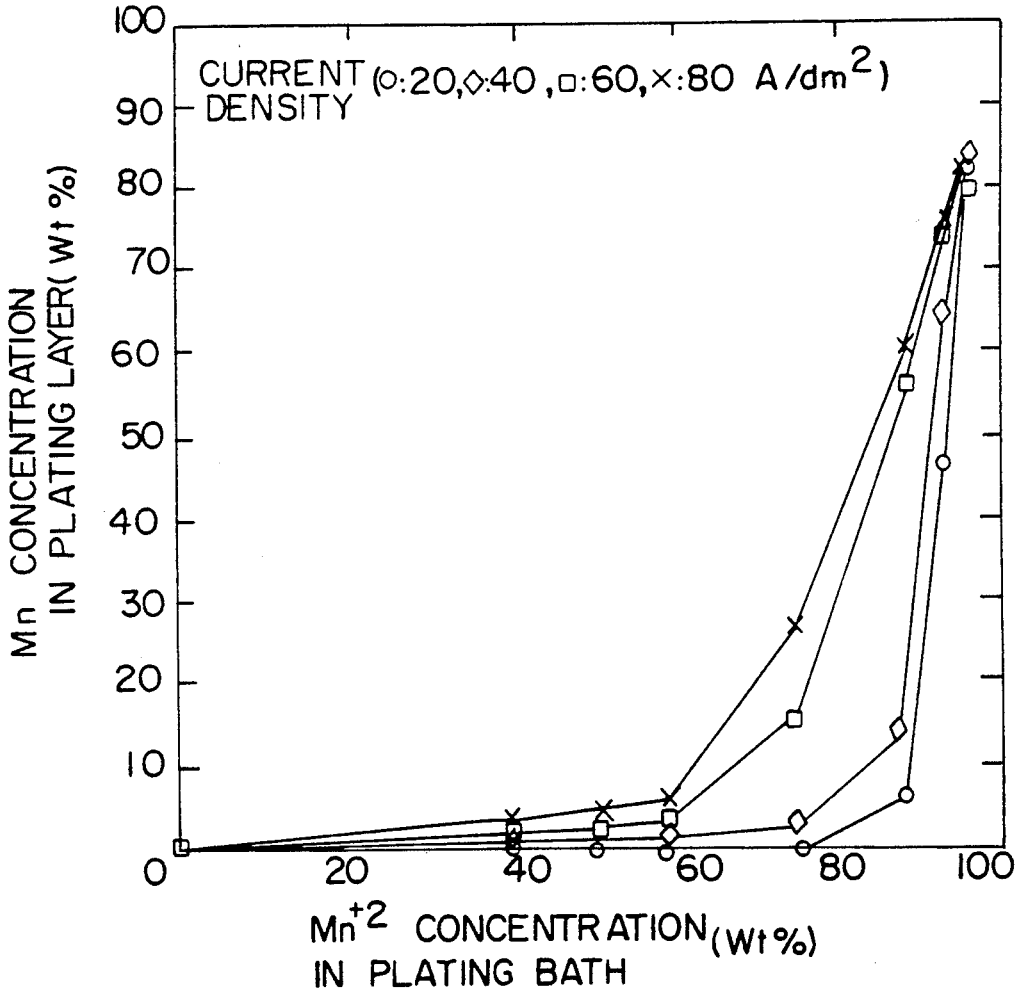
FIG. 1 is a plot showing the relation between $Mn^{+2}$ concentration in plating bath and Mn concentration contained in Fe-Mn plated layer electrodeposited in accordance with the present invention.

The inventors found that excellent phosphate treatability can be obtained by increasing the iron content in the upper plating layer, and that good corrosion resistance after painting can be maintained if hydroxide formed with alloy composition of the upper plating layer is not susceptible to be powder-type.

The inventors also found the fact that excellent adhesion of plated alloy can be obtained if the metal contained in the plating bath is not susceptible to nonelectrolytically react with zinc ion, i.e. if more affinitive metal than zinc with plating bath components is used, peeling-off phenomenon is difficult to occur.

Based on the above-described facts, the inventors succeeded in making a plated steel strip having excellent phosphate treatability, adhesion, and corrosion resistance after painting.

The Fe-Mn plated steel strip according to the present invention comprises a steel strip; a lower layer of Zn or Zn alloy electrodeposited on at least one surface of the said steel strip; and an upper layer of an Fe-Mn alloy with a manganese content of no more than 60% by weight electrodeposited on said lower layer to an amount of at least 0.5 g/m$^2$.

According to the present invention, there is also provided a method for making an Fe-Mn Alloy plated steel strip which comprises;

forming a lower plating layer of Zn or Zn alloy on at least one surface of a steel strip by electroplating the said steel strip with Zn or Zn alloy;

and forming an upper plating layer of Fe-Mn alloy on at least one surface of said lower plating layer electrodeposited on the said steel strip by electroplating the said lower plating layer with Fe-Mn alloy containing no more than 60% by weight of manganese in a Fe-Mn alloy plating bath (chloride bath) containing $Mn^{+2}$ ions in an amount of no more than 95% by weight based on the total amount of metal ions, with the current density being 20–80 A/dm$^2$.

In case that manganese concentration in Fe-Mn alloy becomes more than 60% by weight, good corrosion resistance after painting can be achieved but the adhesion becomes inferior. Thus, it is required to maintain the manganese concentration no more than 60% by weight.

And when the total coating amount of the upper layer deposited on the lower layer exceeds 0.5 g/m$^2$, it is found that, after phosphate treatment, the P-type phosphate film of the phosphate films comprised of Hopeite [$Zn_3(PO_4)_2 \cdot 4H_2O$, hereinafter referred to as "H-type"] and Phosphophyllite [$Zn_2Fe(PO_4)_2 \cdot 4H_2O$, hereinafter referred to as "P-type"] is significantly increased.

Furthermore, when the coating amount of the upper layer is more than 4 g/m$^2$, only the P-type exists. Therefore, its lower limit is set to 0.5 g/m$^2$ while the upper limit is preferably set to less than 4 g/m$^2$ in view of cost.

The amount of $Mn^{+2}$ is preferably no more than 95% by weight based on the total amount of metal ions in the plating bath because the upper plated layer containing no more than 60% by weight of maganese can not be formed at higher amount.

And in case that electroplating is carred out in the plating bath wherein the amount of $Mn^{+2}$ is no more than 95% by weight based on the total amount of metal ions, the current density is preferably in the range of from 20 to 80 A/dm$^2$. Normally, high concentration of $Fe^{+2}$ in the plating bath is required to electroplate a steel strip with Fe-Zn alloy.

But the increase of $Fe^{+2}$ ion in the plating bath causes inferior plating such as build up of black spot on the plated surface and discoloration of the plated layer to grey as well as the amount of $Fe^{+3}$ formed via reaction between $Fe^{+2}$ and resolved oxygen gets increased.

Also if the amount of $Fe^{+3}$ is increased and simultaneously pH of the plating bath becomes higher, $Fe(OH)_3$ precipitations are formed, and thereby resulting in the reduction of current efficiency. Thus, it is conventionally required to keep pH of the plating bath low enough and to control $Fe^{+2}$ ion concentration in the plating bath to be low. But as described above, the concentration of $Fe^{+2}$ in plating bath should be high enough to electroplate a steel sheet with conventional Fe-Mn alloy.

Such antimony may be another problem in the prior art.

However, when using the Fe-Mn plating bath in accordance with the present invention, this problem is not to be concerned as Fe content in the plated layer is high enough to compensate $Fe^{+2}$ deficiency in the plating bath, and it is not necessary to maintain Fe ion concentration in the plating bath to be high.

The following examples are presented to provide a more complete understanding of the invention.

EXAMPLE 1

After completion of plating the zinc-nickel alloy plated steel sheet with the plating bath composition and plating condition list in Table 1, the variation of Mn concentration in the plated upper layer was measured as a function of the $Mn^{+2}/Mn^{+2}+Fe^{+2}$ ratio contained in the Fe-Mn plating bath and the results are given in FIG. 1.

TABLE 1

| PLATING BATH COMPOSITION | | | PLATING CONDITION | | |
|---|---|---|---|---|---|
| MnCl + FeCl (g/L) | KCl (g/L) | Mn $Mn^{+2}+Fe^{+2}$ (wt %) | Temp (°C.) | Current Density (A/dm$^2$) | Flow Rate (m/sec) |
| 82 | 223 | 0, 40, 60, 70, 75, 90, 95, 100 | 60 | 20, 40, 60 | 2 |

As shown in FIG. 1, when the concentration of $Mn^{+2}$ iron in the plating bath is higher than 95 wt %, it is found to be difficult to control the concentration of $Mn^{+2}$ in the plated layer to be less than 60 wt % in spite of conducting the plating process with 20 A/dm$^2$ current density.

On the other hand, it could be understood that the precipitation ratio of Mn ion increases as the current density increases. The reason is that the precipitation rate of Fe ion having a high reduction potential is high, and in case of increasing the current density, the precipitation rate is converted the determined-rate due to diffusion of metal ion.

EXAMPLE 2

Plating was conducted with the same condition in Example 1 except current density was set to 60 A/dm$^2$. And then, sprayed with Pyroclean 442(Tradename, manufactured by Sam Yang Chemical Co., Ltd., Seoul) solution upon the plated surface at 45° C. and for 3 minutes, flushed with water at room temperature for 3 minutes, then proceeded with surface adjustment with Pyroclean Z (Tradename, manufactured by Sam Yang Chemical Co., Ltd., Seoul) solution for 3 minutes and followed by phosphate treatment with Bonderite 699D(Tradename, manufactured by Sam Yang Chemical Co., Ltd.) at 45° C. for 3 minutes.

After water flushing, the examples were Cr-treated with Parcolene 86A(Tradename, manufactured by Sam Yang Chemical Co., Ltd.) at room temperature and followed by washing with water for 3 minutes.

Figure 2:
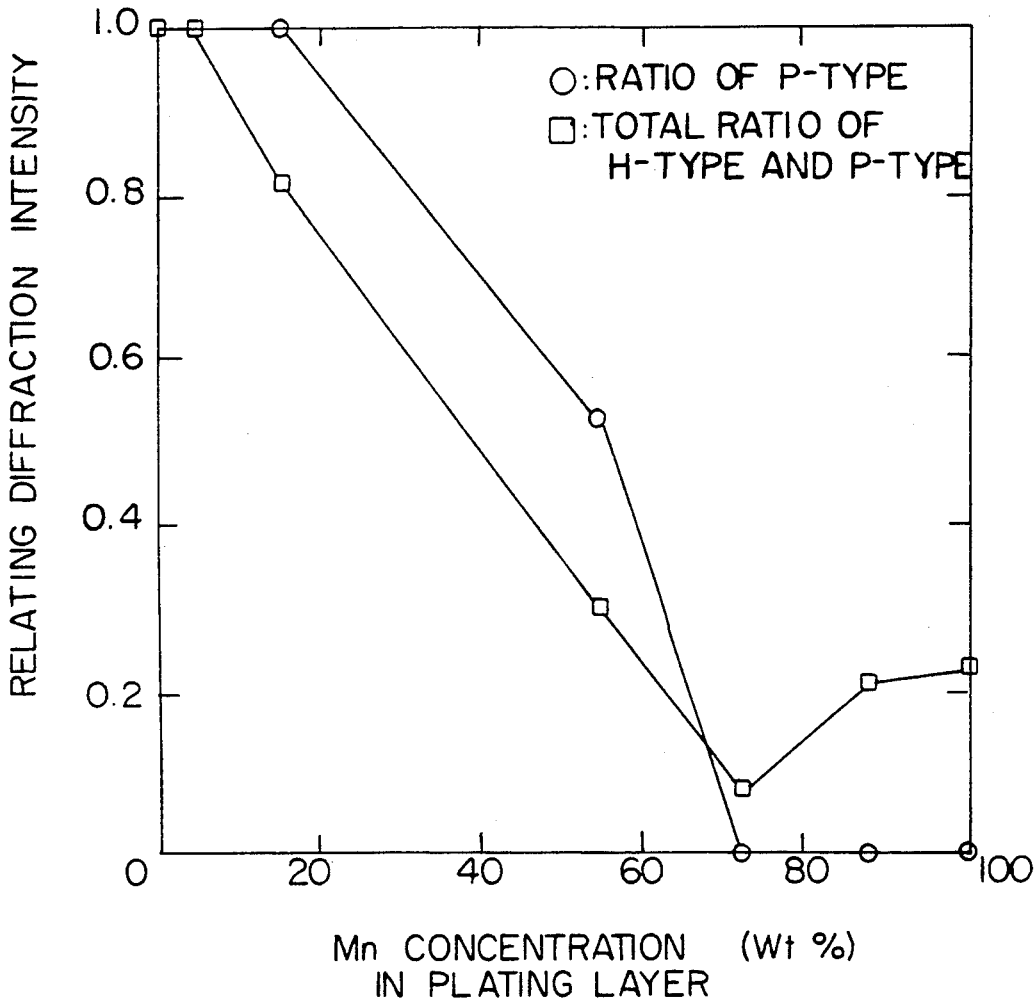
FIG. 2 is a plot showing the relation between Mn concentration in Fe-Mn plated layer and relative X-ray diffraction intensity of phosphate film to the total plating amount.

X-ray diffraction intensity was measured for the phosphate film. FIG. 2 shows the measured relative diffraction intensity as a function of Mn concentration in the plated layer.

The diffraction intensities of H-type and P-type in phosphate film were measured for (020) and (100), respectively and the results are shown in FIG. 2.

The relative amount of the phosphate film is expressed as the ratio to the maximum sum of diffraction intensities for the H-type and P-type, and the ratio of the P-type in the phosphate film is given by the ratio of the diffraction intensity for the P-type to the total diffraction intensities summed up for the P-type and for the H-type.

As shown in FIG. 2, the total amount of phosphate film and P-type ratio decrease as the concentration of Mn in upper layer increases.

And when the concentration of Mn reached more than 70 wt %, the concentration of Fe in the plated layer become reduced and thus, only the P-type was formed.

Especially, as Mn concentration in the plated layer increased, the more manganese oxides were formed. It restrained the plated layer to be dissolved during the phosphate treatment process and consequently the amount of the phosphate film was reduced.

Therefore, when the concentration of Mn in the plating layer is less than 60 wt %, the ratio of the fine particle P-type film in the phosphate film become higher than 0.5.

On the other hand, according to the result of analysis performed with Auger electro microscope(SAM) spottering for the Fe-Mn alloy electroplated layer, it was confirmed that there exists significant amount of oxygen in the entire plated layer if the concentration of Mn in the plated layer is more than 20 wt %. And by analyzing the bond energy of 2 P of Mn using ESCA, it was found that it is composed of complex material having the bond energy 1.7-6 eV higher than that in the metallic state.

This material is being thought as a complex of oxides and hydroxides.

EXAMPLE 3

Figure 3:
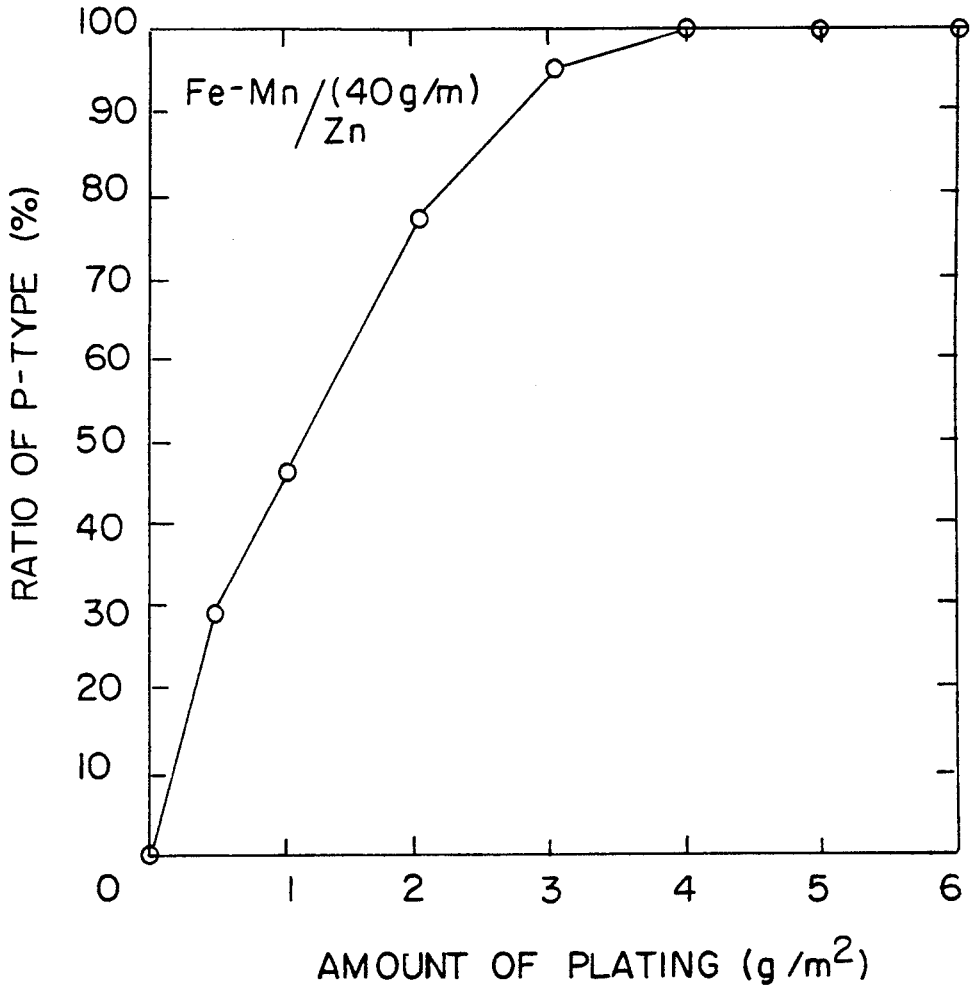
FIG. 3 is a plot showing the relation between the total amount of upper plating layer and P-type phosphate film.

Fe-Mn alloy containing about 3.5 wt % of Mn was electrodeposited on the surface of Zn plated steel sheet, and the fraction of the P-type phosphate film is drawn as a function of the plating amount built on the upper plated layer in FIG. 3.

As shown in FIG. 3, the ratio of the P-type phosphate film is increased as the plating amount of the upper layer increases. And when it reaches about 4 g/m$^2$ and more, the layer containing high concentration of Fe is increasingly deposited onto the surface of the Zn plated lower layer, thereby the amount of zinc dissolved during the process of phosphate treatment was decreased and Fe was increased, which resulted in the formation of P-type only.

However, beyond the range specified in this invention, i.e. less than 0.5 g/m$^2$, the P-type fraction in the phosphate film is significantly low. And samples of the Fe-Mn plated steel sheet with the amount of plating being 5 g/m$^2$ in accordance with the present invention, and of the conventional Zn plated steel sheet, were processed for phosphate treatment and observed their SEM structure. The SEM structures are shown in the photomicrographs in FIG. 4.

Figure 4A:
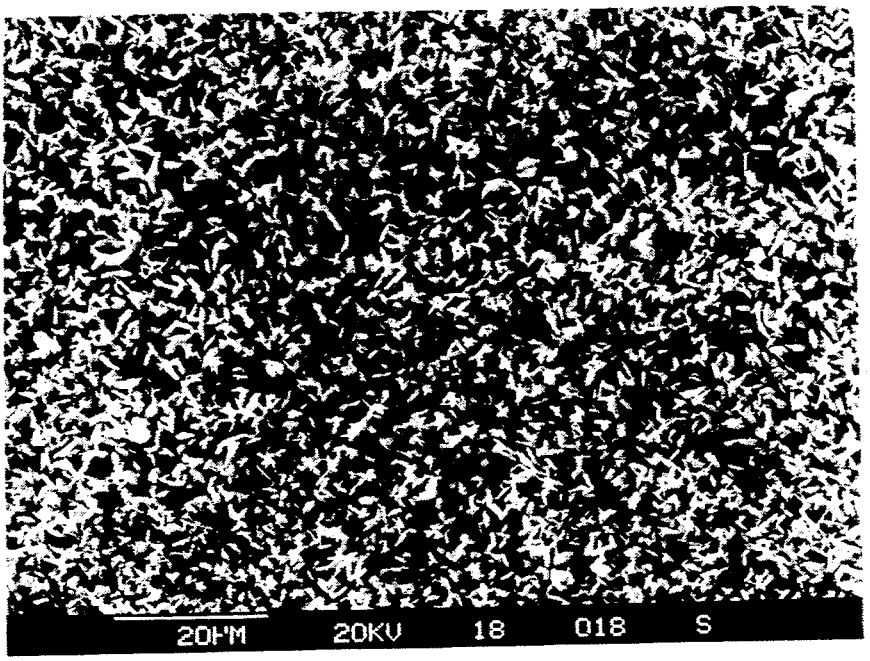
FIG. 4*a* and 4*b* are photomicrograph of phosphate film in Zn plated steel sheet and Fe-Mn alloy plated steel sheet, respectively.
Figure 4B:
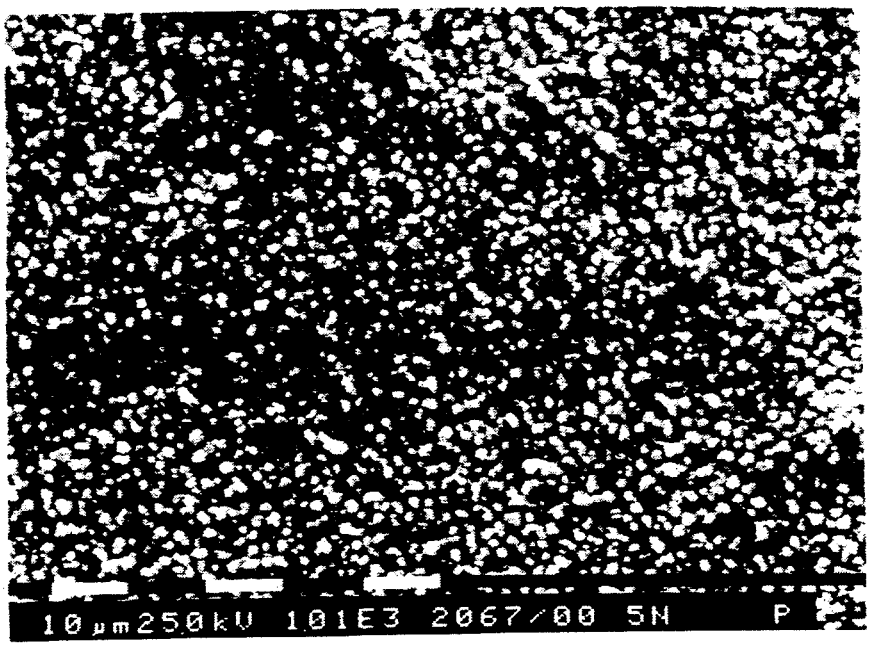

As shown in FIG. 4, for the Mn plated steel sheet (FIG. 4(A)), acicular structure of H-type film is observed, while for the Fe-Mn plated steel sheet (FIG. 4(B)) in accordance with the present invention, only fine granular structure of P-type film is observed.

EXAMPLE 4

For the double layer plated steel sheet produced to have the characteristics of the plated amount and compositions listed in the following Table 2, plating adhesion, wet-adhesion of electrodeposited film and corrosive resistance after painting were measured and the results are given in Table 2.

TABLE 2

| example | System of Layer upper | System of Layer lower | Build-up (g/m$^2$) upper | Build-up (g/m$^2$) lower | compositions of plated layer: upper layer Mn | upper layer Fe | upper layer Zn | upper layer P | lower layer Zn | lower layer Fe | lower layer Ni | adhesion of plating | wet adhesion of film | corrosive resistance after painting corrosion thickness | Evaluation |
|---|---|---|---|---|---|---|---|---|---|---|---|---|---|---|---|
| comparatives | | | | | | | | | | | | | | | |
| a | Fe—Mn | Zn—Fe | 5 | 36 | 88.6 | 11.4 | — | — | 85 | 15 | — | X | X | 2.0 | X |
| b | Fe—Mn | Zn—Fe | 5 | 36 | 74.2 | 25.8 | — | — | 85 | 15 | — | X | X | 2.5 | X |
| c | Fe—Mn | Zn—Fe | 5 | 36 | 55.7 | 44.3 | — | — | 85 | 15 | — | ○ | Δ | 3.0 | Δ |
| examples | | | | | | | | | | | | | | | |
| 1 | Fe—Mn | Zn—Fe | 5 | 36 | 15.5 | 84.5 | — | — | 85 | 15 | | ◎ | ◎ | 1.3 | |
| 2 | Fe—Mn | Zn—Fe | 5 | 36 | 3.5 | 96.5 | — | — | 85 | 15 | — | ◎ | ◎ | 2.1 | |
| 3 | Fe—Mn | Zn—Ni | 5 | 30 | 3.5 | 96.5 | — | — | 87 | — | 13 | ◎ | ◎ | 2.9 | |
| prior art | | | | | | | | | | | | | | | |
| A | Fe—Zn | Zn—Fe | 5 | 36 | — | 83 | 17 | — | 85 | 15 | — | ◎ | ◎ | 2.6 | ◎ |
| B | Fe—Zn | GA | 5 | 50 | — | 83 | 17 | — | 87 | 13 | — | ○ | ◎ | 4.8 | ○ |
| C | Fe—Zn | Zn—Ni | 5 | 30 | — | 83 | 17 | — | 87 | — | 13 | ◎ | ◎ | 4.4 | ○ |
| D | Fe—P | Zn—Ni | 5 | 30 | — | 99.5 | — | — | 87 | — | 13 | Δ | ◎ | 2.6 | ◎ |
| E | Zn—Fe | | 36 | | — | — | — | 0.5 | 85 | 15 | — | ◎ | ◎ | 3.1 | Δ |
| F | Zn—Ni | | 30 | | — | — | — | — | 87 | — | 13 | ◎ | ◎ | 4.2 | Δ |
| G | Zn | | 36 | | — | — | — | — | 100 | — | — | ◎ | ◎ | 13 | Δ |

X: rejected
Δ: fair
○: good
◎: very good
: excellent

As shown in Table 2, the example No. 1-3 of the present invention reveals superior performance in plating adhesion and wet adhesion of the electrodeposited film compared to the comparatives a-c, and also reveals superior performance in corrosive resistance after painting compared to prior art A-G.

Conclusively, the examples of the present invention 1 to 3 are proved to have excellent performance properties of the plating adhesive, wet adhesive of the electrodeposited film as well as corrosive resistance.

As described above, the identified technical specification of the present invention and their associated performance improvements are as follows;

The double layer plating feature that plating is performed with Fe-Mn system on the surface of Zn or Zn alloy plated steel sheet, which can enhance the corrosive resistance; the specific composition of the upper layer that the concentration of Mn is kept below 60 wt %, which increases both the phosphate treatability and wet adhesion, especially when kept below 20 wt %, these properties are excellent; and the process conditions that, in order to obtain the plated layer containing less than 60 wt % of manganese, the current density being the low density range of 20 A/m$^2$, enables the plating process to be conducted even with the bath solution containing high manganese concentration of below 95 wt %, build the significantly increased phosphate film even when only 0.5 g/m$^2$ of Fe-Mn is electrodeposited on the surface of Zn plated steel sheet.

Especially, when the plated amount becomes more than 4 g/m$^2$, the phosphate treatability is significantly improved due to the formation of P-type only.

What is claimed is:

1. An Fe-Mn plated steel sheet, comprising a steel sheet;

a lower layer of Zn or Zn alloy electrodeposited on at least one surface of said steel sheet; and an upper layer of Fe-Mn alloy with a manganese content of no more than 60 % by weight electrodeposited on said lower layer in an amount of at least 0.5 g/m$^2$.

2. A steel sheet according to claim 1, wherein the amount of the upper layer coating is less than 4 g/m$^2$.

3. A steel sheet according to claim 1, wherein the ratio of Mn to Fe in the upper layer is from 15.5:84.5 to 3.5 to 96.5.

4. A steel sheet according to claim 1, wherein the lower layer comprises at least 85% Zn.

5. A steel sheet according to claim 4, wherein the lower layer is a Zn-Fe or Zn-Ni alloy.

6. A steel sheet according to claim 5, wherein the ratio of Mn to Fe in the upper layer is from 15.5:84.5 to 3.5 to 96.5; wherein the lower layer is a Zn-Fe or Zn-Ni alloy with a Zn content of at least about 85%.

* * * * *